US011732215B2

(12) United States Patent
Nguyen et al.

(10) Patent No.: US 11,732,215 B2
(45) Date of Patent: Aug. 22, 2023

(54) AQUEOUS GEL CLEANING COMPOSITION FOR LIPOPHILIC STAIN REMOVAL FROM VEHICLE SURFACES

(71) Applicant: Illinois Tool Works Inc., Glenview, IL (US)

(72) Inventors: Chi Quang Nguyen, Glenview, IL (US); John Isidoro Escoto, Jr., Glenview, IL (US); John Nemec, Glenview, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 153 days.

(21) Appl. No.: 17/411,652

(22) Filed: Aug. 25, 2021

(65) Prior Publication Data

US 2022/0064570 A1 Mar. 3, 2022

Related U.S. Application Data

(60) Provisional application No. 63/070,441, filed on Aug. 26, 2020.

(51) Int. Cl.
*C11D 1/72* (2006.01)
*C11D 1/722* (2006.01)
(Continued)

(52) U.S. Cl.
CPC ..... *C11D 1/831* (2013.01); *B08B 7/0014* (2013.01); *C11D 3/08* (2013.01); *C11D 3/3765* (2013.01);
(Continued)

(58) Field of Classification Search
CPC .. B08B 3/04; C11D 1/665; C11D 1/72; C11D 1/722; C11D 1/75; C11D 1/825;
(Continued)

(56) References Cited

U.S. PATENT DOCUMENTS 5,871,590 A * 2/1999 Hei ..... C11D 11/0041 252/79.4
7,271,136 B2 * 9/2007 Britton ..... C11D 3/08 134/40

(Continued)

*Primary Examiner* — Brian P Mruk
(74) *Attorney, Agent, or Firm* — MaxGoLaw PLLC

(57) ABSTRACT

A gellable vehicle surface cleaning composition is provided that includes a non-ionic surfactant combined with gelling components of an inorganic gel forming substance and at least one water soluble polymer in a ratio of the inorganic gel forming substance to the hydrophilic polymer of between 0.1-1:1. The non-ionic surfactant and the gelling components are provided in an aqueous solvent system. The aqueous solvent system includes a first solvent having a Kamlet-Taft solvent polarity α (K-T α) value of zero, a second solvent having a K-T α 0.6-0.85 value, and water present at more than 50 total weight percent. A process of for cleaning a vehicle surface with a stain is also provided that includes the composition to the stain on the vehicle surface a composition and after allowing sufficient time for the composition to lift the stain, the stain and the composition are removed from the vehicle surface.

20 Claims, 2 Drawing Sheets
(2 of 2 Drawing Sheet(s) Filed in Color)

(51) Int. Cl.

| | |
|---|---|
| ***C11D 1/75*** | (2006.01) |
| ***C11D 1/825*** | (2006.01) |
| ***C11D 3/08*** | (2006.01) |
| ***C11D 3/37*** | (2006.01) |
| ***C11D 3/43*** | (2006.01) |
| ***B08B 3/04*** | (2006.01) |
| ***C11D 1/831*** | (2006.01) |
| ***C11D 11/00*** | (2006.01) |
| ***C11D 17/00*** | (2006.01) |
| ***C11D 3/382*** | (2006.01) |
| ***B08B 7/00*** | (2006.01) |
| *C11D 1/22* | (2006.01) |

(52) U.S. Cl.
CPC ..... *C11D 3/382* (2013.01); *C11D 3/43* (2013.01); *C11D 11/0023* (2013.01); *C11D 17/003* (2013.01); *C11D 17/0043* (2013.01); *C11D 1/22* (2013.01); *C11D 1/72* (2013.01); *C11D 1/75* (2013.01)

(58) Field of Classification Search
CPC ..... C11D 3/08; C11D 3/1246; C11D 3/1253; C11D 3/1266; C11D 3/162; C11D 3/2006; C11D 3/2034; C11D 3/2037; C11D 3/2041; C11D 3/37; C11D 3/43
USPC ..... 510/189
See application file for complete search history.

(56) References Cited

U.S. PATENT DOCUMENTS

| | | | | |
|---|---|---|---|---|
| 2004/0097390 | A1* | 5/2004 | Jordan | C11D 3/14 510/189 |
| 2005/0282719 | A1* | 12/2005 | Egan | C11D 3/37 510/183 |
| 2015/0368593 | A1* | 12/2015 | Serobian | C11D 3/222 510/189 |

* cited by examiner

AQUEOUS GEL CLEANING COMPOSITION FOR LIPOPHILIC STAIN REMOVAL FROM VEHICLE SURFACES

RELATED APPLICATIONS

This application claims priority benefit of U.S. Provisional Application Ser. No. 63/070,441, filed Aug. 26, 2020; the contents of which are hereby incorporated by reference.

FIELD OF THE INVENTION

The present invention in general relates to a cleaning composition for various substrates and to a substrate coated with such composition, and in particular, to an aqueous gel composition for removal of lipophilic stains such as grime, brake dust, insect splatter, tar, tree sap, sticker adhesive and bird droppings from vehicle surfaces.

BACKGROUND OF THE INVENTION

Vehicles have a tendency to accumulate a variety of surface contaminants such as grime, brake dust, insect splatter, tar, tree sap, sticker adhesive and bird droppings. The severity of this tendency depends on the type of vehicle, season, driving habits, weather, traffic conditions, among various other factors. If the contaminants have sufficient residence time on the vehicle surface, subsequent removal becomes difficult and eventually leads to surface damage such as pitting. A common feature of these surface contaminants is that they tend to be lipophilic and as a result, are not easy removed with soap or even detergents absent mechanical forces. The removal of such stains with manual rubbing is both time consuming and can lead to underlying surface marring. Removal is further complicated when the vehicle surface is angled so that sprayed cleaning compositions run off or the target stain is not readily accessible such as when on a vehicle roof, fascia, or mud flap.

Owing to these limitations of aqueous cleaners, a variety of cleaning materials are routinely used to clean specific lipophilic stains. By way of example, solvent-based cleaners inclusive of petroleum distillates, xylene, ethyl acetate, or other organic solvents are routinely used to remove grime, brake dust, insect splatter, tar, tree sap, sticker adhesive and bird droppings from various vehicle surfaces. While highly effective, such solvents are VOC emitters and still require manual application, as well as requiring proper disposal.

The current organic solvent-based products are time consuming to use from a professional standpoint and for a consumer represents another product that must be purchased and stored to properly clean a vehicle. While products capable of combining the functions of an aqueous detergent with that of a lipophilic stain remover have been made, as detailed for example in U.S. Pat. No. 5,660,641 such products have met with limited success as the applied solutions tend to run off vehicle surfaces too quickly to properly wet and lift a lipophilic stain thereby leaving a user to yet again resort to manual force to scrub the lipophilic stain from the vehicle surface.

Various non-caustic and environmentally safe components of cleaning agents have been demonstrated to be capable of removing greasy and oily soils from a variety of surfaces to be cleaned. For example, a non-caustic cleaner is described in U.S. Pat. No. 4,511,488 which comprises d-limonene. The cleaning compositions is effective for industrial cleaning tasks, such as those in machine shops, automotive service centers, food processing industries, where oily and particulate soils accumulate.

Thus, there exists a need for an aqueous vehicle surface cleaning composition that can lift lipophilic stains with limited or no manual scrubbing. There further exists a need for an aqueous vehicle surface cleaning composition capable of lifting lipophilic stains that is a gel that is also sprayable. There further exists a need for an aqueous vehicle surface cleaning composition that is operative as a prewash or standalone stain remover that can be sprayed-on and wiped-off after the stain has been lifted from the underlying vehicle surface.

SUMMARY OF THE INVENTION

A gellable vehicle surface cleaning composition is provided that includes a non-ionic surfactant or a mixture of non-ionic surfactants combined with gelling components of an inorganic gel forming substance and at least one water soluble polymer in a ratio of the hydrophilic polymer to the inorganic gel forming substance of between 0.1-1:1. The non-ionic surfactant and the gelling components are provided in an aqueous solvent system. The aqueous solvent system includes at least one first solvent having a Kamlet-Taft solvent polarity (K-T $\alpha$) value of zero, at least one second solvent having a K-T $\alpha$ 0.6-0.85 value, and water present at more than 50 total weight percent.

A process of for cleaning a vehicle surface with a stain is also provided that includes applying the composition to the stain on the vehicle surface and after allowing sufficient time for the composition to lift the stain, the stain and the composition are removed from the vehicle surface.

BRIEF DESCRIPTION OF THE DRAWINGS

The application file contains at least one drawing executed in color. Copies of this patent application publication with color drawings will be provided by the Office upon request and payment of the necessary fee.

DETAILED DESCRIPTION OF THE INVENTION

Figure 1:
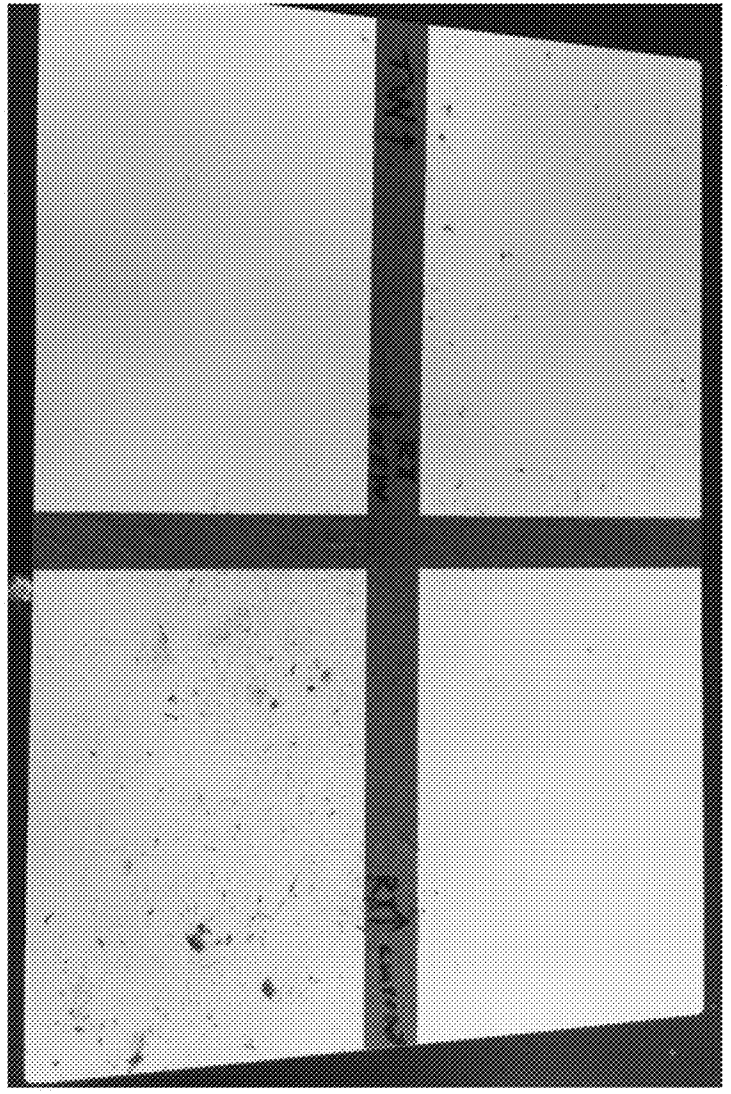
FIG. 1 is a photograph of a panel in which quadrants I and II are cleaned of bug splatter residue with competitive commercially available products, quadrant III is cleaned with an inventive composition under similar conditions quadrants I and II, and quadrant IV is a negative control that has not been cleaned.

The present invention has utility as a vehicle exterior and interior hard surface cleaning composition. An inventive composition is an aqueous thixotropic gel that provides cling ability to vehicle surfaces for effective cleaning regardless of orientation yet is sprayable. As a result, an inventive composition in some embodiments is spray applied to a vehicle surface and after sufficient dwell time as a gel acts as pre-wash or stain remover per se to remove the aforementioned lipophilic stains of grime, brake dust, insect splatter, tar, tree sap, sticker adhesive and bird droppings.

Numerical ranges cited herein are intended to recite not only the end values of such ranges but the individual values encompassed within the range and varying in single units of the last significant figure. By way of example, a range of from 0.1 to 1.0 in arbitrary units according to the present invention also encompasses 0.2, 0.3, 0.4, 0.5, 0.6, 0.7, 0.8, and 0.9; each independently as lower and upper bounding values for the range.

As used herein, "hydrotrope" is defined as compound that solubilizes hydrophobic compounds in aqueous solutions by means other than micellar solubilization and includes a hydrophilic moiety and a hydrophobic moiety yet is too small to cause spontaneous self-aggregation.

As used herein, "builder" is defined as compound added to a improve cleaning properties by increasing the removal of soil and inhibiting its redeposition.

An inventive cleaning composition is based on non-ionic surfactants. Non-ionic surfactants operative herein soluble in water, alcohol, and biobased solvent systems detailed herein. Non-ionic surfactants operative herein in some inventive embodiments have hydrophile/lipophile balance (HLB) values between 8 and 14. Classes of non-ionic surfactants operative herein include $C_9$-$C_{24}$ fatty acid esters, $C_{12}$-$C_{24}$ fatty alcohol ethers and $C_{10}$-$C_{24}$ amine oxides, nonylphenol ethoxylate, each alone or any of the aforementioned in combination. Other alcohol alkoxylates operative herein have the general formula:

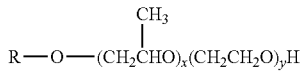

where R is $C_4$-$C_{22}$ linear or branched chain alkyl or mixtures thereof; x has a value of from 2 to 20; y has a value of from 0 to 15, or the general formula:

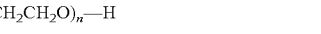

where n is average moles of ethylene oxide (EO) and R is a $C_9$-$C_{18}$ alkyl.

Specific non-ionic surfactants operative herein illustratively include lauramidopropylamine oxide, myristamidopropylamine oxide, a mixed lauramidopropylamine and myristamidopropylamine oxide, $C_{9-11}$ ethoxylated alcohols having EO values from 2.5-97 or combinations thereof. In some inventive embodiments, EO 2.5 $C_{9-11}$ ethoxylated alcohol is used in combination with one or more EO 6-9 $C_{9-11}$ ethoxylated alcohols. The ratio of EO 2.5: EO 6-9 $C_{9-11}$ ethoxylated alcohols being between 0.1-1:1. In still other embodiments, the mixing 2.5 EO and 6-9EO $C_{9-11}$ ethoxylated alcohols are used in combination with a non-ionic amine oxide. Typical loadings of all non-ionic surfactants present in an inventive composition range from 1 to 15 total weight percent.

Components in an inventive composition that form a gel in the solvent system include a combination of: (a) an inorganic gel forming substance from the classes of phyllosilicate, either natural smectite clay or synthetic layered silicate, or combination thereof; with (b) at least one water soluble polymer of: an alkali soluble emulsion polymer, a Hydrophobically modified alkali-soluble emulsion polymer, butyl acrylate-methacrylic acid-methyl methacrylate copolymer, hydrophobically modified non-ionic polyol, cellulose ethers, natural gums or combination thereof. The ratio of inorganic gel forming substance:hydrophilic polymer is between 0.1-1:1. Typical loadings of gel forming components in an inventive composition range from 0.2 to 3 total weight percent. Phyllosilicates operative herein for a gel in the inventive composition and illustratively include $KMg_2AlSi_4O_{12}$; $Al_3Si_4N_2O_{10}$; $K_{1-x}Ca_xMg_2Al_{1+x}Si_{4-x}O_{12}$, where $0.10 \leq x \leq 0.40$; $NaAl_3Si_2Al_2O_{12}$; $KAl_3Si_2Al_2O_{12}$; $CaMg_3Si_4O_{12}$; $BaMg_3Si_4O_{12}$; $SrMg_3Si_4O_{12}$; $KTiAlSi_4O_{12}$; and combinations thereof.

The solvent system of an inventive composition includes water as the majority by weight solvent (Kamlet-Taft solvent polarity value $\alpha$ of 1.05) with lesser amounts of miscible secondary solvents. The minority solvents include: (a) at least one solvent having a Kamlet-Taft solvent polarity value $\alpha$ (K-T $\alpha$) of 0, and (b) at least one solvent having a K-T $\alpha$ value of between 0.60 and 0.85. K-T values for a variety of solvent are detailed in the Doctoral Thesis of James Richard Sherwood, University of York, Department of Chemistry, July 2013, pages 265-267. In certain inventive embodiments, the secondary solvents are derived from natural sources.

Solvents with K-T $\alpha$ of 0 operative herein illustratively include orange oil terpenes, cumene, limonene, $\alpha$-pinene, cineole, p-xylene, or combinations thereof.

Solvents with K-T $\alpha$ of between 0.60 and 0.85 operative herein illustratively include ethyl lactate (0.69), 2-(2-butoxyethoxy)ethanol, (0.79), hydrophobic glycol ether (0.79), 1-butanol (0.73), ethylene glycol (0.79), 2-propanol (0.66), propanediol, or combinations thereof.

A ratio of water: K-T $\alpha$ 0 solvent: K-T $\alpha$ 0.60-0.85 solvent is 1:0.02-0.16:0.06-0.2. In some inventive embodiments, the K-T $\alpha$ 0 solvent is orange oil terpenes. In other inventive embodiments, the K-T $\alpha$ solvent of between 0.60 and 0.85 is a combination of ethyl lactate and 2-(2-butoxyethoxy) ethanol.

Optional additives in an inventive composition illustratively include a hydrotrope, a builder, and a pH modifier. A hydrotrope illustratively includes xylene sulfonate, cumene sulfonate, p-toluene sulfonate, or combinations thereof and is typically being present from 0 to 10 total weight percent and preferably between 5 and 9 total weight percent. A builder illustratively includes liquid sodium silicate, potassium carbonate, sodium carbonate, sodium citrate, or combinations thereof and is typically being present from 0 to 5 total weight percent and preferably between 1 and 3 total weight percent. pH modifiers operative herein illustratively include amino-2-hydroxyethane, 2-[bis(2-hydroxyethyl) amino]ethanol, 2-amino-2-methyl-1-propanol, soda ash, sodium hydroxide, and lime. In some embodiments, a pH modifier is present in an amount to achieve a composition pH of between 8.0 and 12.0.

An inventive composition is readily applied to a substrate by swabbing, pump spray, or by application from a spray aerosol can. As such, a propellant is optionally added in a range from 5 to 95 total weight percent. Suitable propellants illustratively include alkanes such as butane, pentane, isobutane, propane; ethers such as dimethyl ether, diethyl ether, nitrogen; halogenated hydrocarbons; carbon dioxide and combinations thereof. The resultant formulation inclusive of a propellant is seated within a conventional metal aerosol canister and applied by spray application.

Regardless of the mode of application of an inventive composition to a vehicle substrate, upon contacting the vehicle surface, the applied composition forms a stable gel that is non-Newtonian fluid with a pseudoplastic index of 1.2-6.0, and in some embodiments of 2.0-3.0. The gel containing the non-ionic surfactants and the full complement of optional additives lifts the lipophilic stain from the vehicle surface.

The formulary of an inventive composition is summarized below in Table 1.

TABLE 1

| Inventive Cleaning Composition (exclusive of propellants). | | |
|---|---|---|
| Component | Typical Amount Total Wt. Percent | Pref. Amount - Total Wt. Percent |
| Non-ionic surfactants | 1-15 | 3-8 |
| Gel components | 0.1-3 | 0.5-1.5 |
| Inorganic gel forming substance | | |
| Water soluble polymer | | |
| Solvent system | Remainder | Remainder |
| K-T α 0 solvent | | |
| K-T α 0.6-0.85 solvent | | |
| Water | >50% | >60% |
| Optional components | | |
| Hydrotrope | 0-10 | 2-5 |
| Builder | 0-5 | 1-3 |
| pH modifier | to pH 8.0-12.0 | to pH 9.0-11.0 |

Specific exemplary formulations of an inventive composition are provided, unless noted otherwise, all percentages for the specific formulation are total weight percentages.

| Inventive composition 1. | |
|---|---|
| Ingredient | Weight % |
| Water | 76.98% |
| Phyllosilicate | 0.50% |
| Acrylic copolymer | 0.85% |
| 2-(2-butoxyethoxy)ethanol | 5.00% |
| Ethyl Lactate | 3.00% |
| Sweet orange oil | 3.67% |
| Alcohols, C9-11, ethoxylated, 8 EO | 1.00% |
| Alcohols, C9-11, ethoxylated, 2.5 EO | 1.00% |
| Lauramidopropylamine Oxide/Myristamidopropylamine Oxide | 1.0% |
| Sodium Xylene Sulfonate | 3.0% |
| Monoethanolamine | 2.50% |
| Sodium Hydroxide | 0.3% |
| Sodium silicate | 0.20% |
| Potassium carbonate, Anhydrous | 1.00% |
| | 100% |

| Inventive composition 2. | |
|---|---|
| Ingredient | Weight % |
| Water | 70.50% |
| Phyllosilicate | 0.50% |
| Acrylic copolymer | 1.0% |
| 2-(2-butoxyethoxy)ethanol | 5.00% |
| Ethyl Lactate | 3.00% |
| Sweet orange oil | 3.67% |
| Alcohols, C9-11, ethoxylated, 8 EO | 1.50% |
| Alcohols, C9-11, ethoxylated, 2.5 EO | 1.50% |
| Lauramidopropylamine Oxide/ Myristamidopropylamine Oxide | 1.0% |
| Sodium Cumenesulfonate | 3.45% |
| Monoethanolamine | 4.00% |
| Sodium Hydroxide | 0.5% |
| Sodium silicate | 0.2% |
| Sodium Carbonate | 1.0% |
| | 100% |

| Inventive composition 3. | |
|---|---|
| Ingredient | Weight % |
| Water | 57.40% |
| Acrylic copolymer | 0.60% |
| 2-(2-butoxyethoxy)ethanol | 5.00% |
| Ethyl Lactate | 9.00% |
| Sweet orange oil | 11.00% |
| Alcohols, C9-11, ethoxylated, 8 EO | 4.50% |
| Alcohols, C9-11, ethoxylated, 2.5 EO | 4.50% |
| Lauramidopropylamine Oxide/ Myristamidopropylamine Oxide | 4.50% |
| 2-Amino-2-methyl-1-propanol | 2.50% |
| Potassium Carbonate | 1.00% |
| | 100% |

The advantages of this invention are more particularly shown by the following examples in which the parts and percentages are by weight unless otherwise indicated.

Example 1 and Comparative Examples

A panel of material is uniformly covered in bug splatter and divided into four quadrants with adhesive tape. Inventive composition 1 is shear thinned with a pump spray and applied to quadrant III of the panel while a vertical orientation and allowed to dwell for 1-2 minutes prior to spray washing with water. Competitive commercial product RX was applied per instructions: 1-2 minutes to quadrant I. Competitive commercial product TW was applied per instructions: 1-2 minutes to quadrant II. FIG. 1 is a photograph of the panel after drying, with quadrant IV being a negative control that has not been cleaned.

Example 2

Figure 2A:
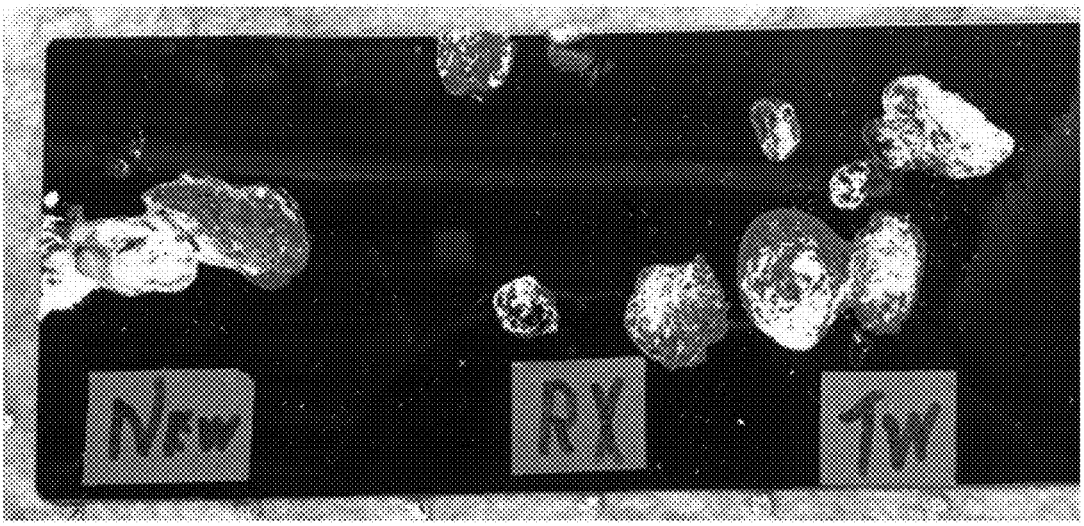
FIGS. 2A and 2B are photographs of a panel covered in bird droppings (FIG. 2A) and cleaned (FIG. 2B) where "New" denotes the present invention and RX and TW denote competitive commercially available products.
Figure 2B:
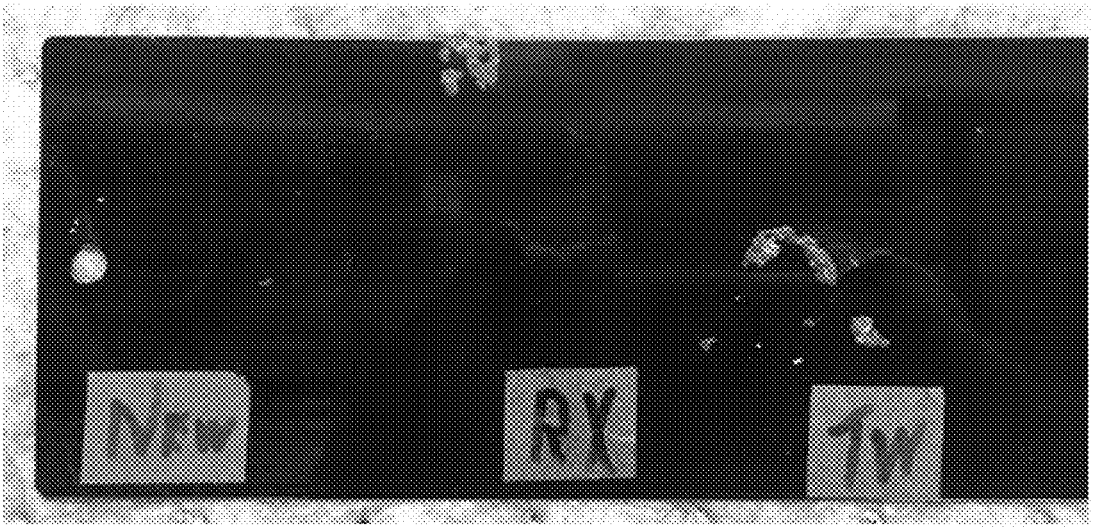

The process of Example 1 is repeated with the formulation of inventive composition 1 and the panel having been covered in bird droppings. FIG. 2A is a photograph of the panel before being cleaned. FIG. 2B are photographs of a panel after cleaning per Example 1 where "New" denotes the inventive composition 1 and RX and TW denote the competitive commercially available products.

Examples 3-6

The process of Example 1 is repeated with panels coated with tar (Example 3), tree sap (Example 4), adhesive residue (Example 5), and road grime (Example 6), with the inventive composition 1 performing as well or better than the competitive products.

Example 7-8

The process of Examples 1 and 2 are repeated with inventive composition 2 in place of inventive composition 1 with like results.

Example 9

The process of Example 1 is repeated with 10.00% of lauramidopropylamine oxide/myristamidopropylamine oxide, a removal of the ethoxylated alcohols and a corresponding change in the amount of water relative to the formulation of inventive composition 1 with like results.

Example 10

The process of Example 1 is repeated with 4.00% butyl acrylate-methyl methacrylate polymers, a removal of the acrylic acid copolymer and a corresponding change in the amount of water relative to the formulation of inventive composition 1 with like results.

Example 11

The process of Example 1 is repeated with a like amount of cumene replacing orange oil terpenes (sweet orange oil); and a like amount of 1-butanol replacing the ethyl lactate and 2-(2-butoxyethoxy)ethanol in the formulation of inventive composition 1 with like results.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention but is not meant to be a limitation upon the practice thereof. The following claims, including all equivalents thereof are intended to define the scope of the invention.

The invention claimed is:

1. A gellable vehicle surface cleaning composition comprising:

a non-ionic surfactant;

gelling components comprising:

an inorganic gel forming substance of a phyllosilicate, natural smectite clay or synthetic layered silicate, or combination thereof; and at least one hydrophilic polymer of an alkali soluble emulsion polymer, a hydrophobically modified alkali-soluble emulsion polymer, butyl acrylate-methacrylic acid-methyl methacrylate copolymer, hydrophobically modified non-ionic polyol, natural gums, or combination thereof, with a ratio of said inorganic gel forming substance: said at least one hydrophilic polymer of between 0.1-1:1; and an aqueous solvent system in which said non-ionic surfactant and said gelling components are present, said aqueous solvent system comprising a first solvent having a Kamlet-Taft solvent polarity $\alpha$ value of zero, a second solvent having a Kamlet-Taft solvent polarity $\alpha$ 0.6-0.85 value; and water present at more than 50 total weight percent.

2. The composition of claim 1 wherein said non-ionic surfactant has a hydrophile/lipophile balance (HLB) value of between 8 and 14.

3. The composition of claim 1 wherein said non-ionic surfactant comprises at least one alcohol alkoxylates having a formula:

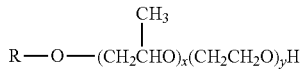

$$R-O-(CH_2\overset{CH_3}{\overset{|}{C}}HO)_x(CH_2CH_2O)_yH$$

where R is $C_4$-$C_{22}$ linear or branched chain alkyl or mixtures thereof; x has a value of from 2 to 20; y has a value of from 0 to 15, or $$R^1O-(CH_2CH_2O)_n-H$$

where n is average moles of ethylene oxide (EO) from 2.5-9 and $R^1$ is a $C_9$-$C_{18}$ alkyl.

4. The composition of claim 1 wherein said non-ionic surfactant comprises lauramidopropylamine oxide and/or myristamidopropylamine oxide.

5. The composition of claim 1 wherein said non-ionic surfactant comprises $C_{9-11}$ ethoxylated alcohols having ethylene oxide values from 2.5-9, and combinations thereof.

6. The composition of claim 5 wherein said non-ionic surfactant comprises ethylene oxide 2.5 $C_{9-11}$ ethoxylated alcohol is used in combination with one more ethylene oxide 6-9 $C_{9-11}$ ethoxylated alcohols.

7. The composition of claim 6 wherein a ratio of ethylene oxide 2.5 $C_{9-11}$ ethoxylated alcohol: ethylene oxide 6-9 $C_{9-11}$ ethoxylated alcohols is between 0.1-1:1.

8. The composition of claim 1 wherein said non-ionic surfactant is present from 1 to 15 total weight percent.

9. The composition of claim 1 wherein said inorganic gel forming substance is a synthetic phyllosilicate.

10. The composition of claim 1 wherein a ratio of said inorganic gel forming substance: said at least one hydrophilic polymer is between 0.5-0.58:1.

11. The composition of claim 1 wherein said gel forming components are present from 0.1 to 3 total weight percent.

12. The composition of claim 1 wherein said first solvent is orange oil terpenes, cumene, limonene, $\alpha$-pinene, cineole, p-xylene, or combinations thereof.

13. The composition of claim 1 wherein said second solvent is ethyl lactate, 2-(2-butoxyethoxy)ethanol, hydrophobic glycol ether, 1-butanol, ethylene glycol, 2-propanol, tripropylene glycol n-butyl ether, or combinations thereof.

14. The composition of claim 1 wherein a ratio of water:said first solvent: said second solvent is 1:0.02-0.16:0.06-0.2.

15. A process of cleaning a vehicle surface with a stain comprising:

applying to the stain on the vehicle surface a composition of claim 1;

allowing the composition to dwell on the stain; and removing the stain and the composition from the vehicle surface.

16. The process of claim 15 wherein the applying the composition is spraying or pressurized aerosol.

17. The process of claim 15 wherein the composition gels after the applying.

18. The process of claim 15 wherein the removing is by water washing.

19. The process of claim 15 further comprising washing the vehicle surface after the removing.

20. The process of claim 15 wherein the stain is at least one of grime, brake dust, insect splatter, tar, tree sap, sticker adhesive, or bird droppings.

* * * * *